US012768531B2

(12) United States Patent
Ritter et al.

(10) Patent No.: US 12,768,531 B2
(45) Date of Patent: Oct. 20, 2026

(54) STEAM GENERATOR

(71) Applicant: J. WAGNER GmbH, Markdorf (DE)

(72) Inventors: Tino Ritter, Bermatingen (DE); Marius Geldon, Markdorf (DE); Peter Ibele, Horgenzell (DE); Holger Stohl, Markdorf (DE)

(73) Assignee: J. WAGNER GmbH, Markdorf (DE)

( * ) Notice: Subject to any disclaimer, the term of this patent is extended or adjusted under 35 U.S.C. 154(b) by 719 days.

(21) Appl. No.: 18/333,013

(22) Filed: Jun. 12, 2023

(65) Prior Publication Data

US 2024/0003533 A1 Jan. 4, 2024

(51) Int. Cl.
*F22B 1/28* (2006.01)
*F22B 33/12* (2006.01)

(52) U.S. Cl.
CPC ..... *F22B 1/285* (2013.01); *F22B 33/12* (2013.01)

(58) Field of Classification Search
CPC ..... F22B 1/284; F22B 1/285; F22B 33/12
USPC ..... 392/405
See application file for complete search history.

(56) References Cited

U.S. PATENT DOCUMENTS 3,581,529 A 6/1971 Mitchell et al.
3,910,498 A * 10/1975 Harrison ..... F22B 1/284 392/401
4,518,847 A * 5/1985 Horst, Sr. ..... F24H 3/081 237/16
4,810,854 A 3/1989 Jursich et al.
5,555,752 A * 9/1996 Fitzpatrick ..... E05B 47/02 70/159
6,243,535 B1 * 6/2001 Bochud ..... F22B 1/285 392/475
2005/0276585 A1 * 12/2005 Yao ..... A45D 19/16 392/405
2022/0126031 A1 4/2022 Thurman

FOREIGN PATENT DOCUMENTS

DE 202012003416 U1 4/2012
DE 1010006766 A1 10/2012
DE 202022101149 U1 3/2022
WO 2021228647 A1 11/2021

OTHER PUBLICATIONS

European Search Report for European Patent Application No. 23175390.6 dated Jan. 8, 2024, 7 pages.

* cited by examiner

*Primary Examiner* — Sang Y Paik
(74) *Attorney, Agent, or Firm* — Christopher J. Volkmann; KELLY, HOLT & CHRISTENSON PLLC

(57) ABSTRACT

The present disclosure relates to a steam generator (1) comprising a storage container (12), a filling pump, a steam boiler unit, an applicator and a housing (2). In this case, the housing (2) comprises a tank (3) with a receiving space and a cover (4), wherein the steam boiler unit is inserted into the tank (3) in a lower region of the receiving space and wherein the storage container (12) is inserted into the tank (3) in a central region of the receiving space above the steam boiler unit.

14 Claims, 8 Drawing Sheets

STEAM GENERATOR

CROSS-REFERENCES TO RELATED APPLICATION

This application claims the benefit of German Application No. 10 2022 116 252.4, filed Jun. 29, 2022.

DETAILED DESCRIPTION

Figure 1:
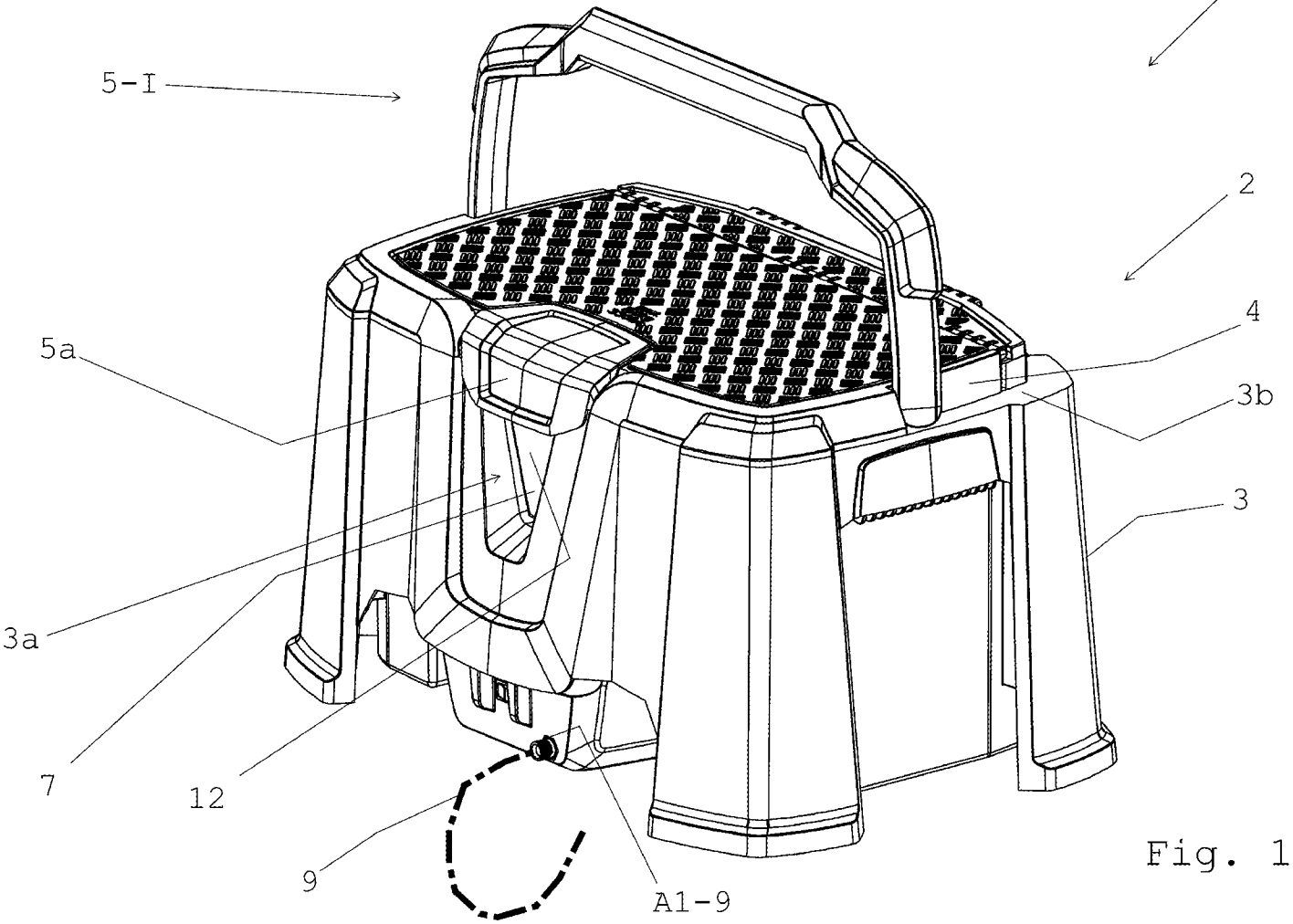
FIG. 1 shows a perspective view of a steam generator, in one example.

The present disclosure relates to a steam generator according to the preamble of claim 1.

DE 10 2011 006 766 A1 discloses a steam generator which comprises a storage container, a filling pump, a steam boiler unit, an applicator and a housing.

An object of the present disclosure is to provide a steam generator which has a compact and maintenance-friendly construction and the transport and storage of which are simplified.

This object is achieved on the basis of the features of the preamble of claim 1 by the characterizing features of claim 1. The dependent claims set out advantageous and expedient further developments.

The steam generator according to the present disclosure comprises a storage container, a filling pump, a steam boiler unit, an applicator and a housing, wherein the housing comprises a tank with a receiving space and a cover, wherein the steam boiler unit is inserted in the tank in a lower region of the receiving space and wherein the storage container is inserted in the tank in a central region of the receiving space above the steam boiler unit. As a result of such an arrangement and layering of the individual components, both a compact construction and maintenance-friendliness are ensured because the components are layered in accordance with the relevance thereof, and the transport and storage thereof are simplified because all the components can be stored in the housing.

There may further be provision for the tank to be provided with a device coupling which is connected to a tank base and the steam boiler unit to be provided with a device connector, wherein the device connector of the steam boiler unit is connected to the device coupling completely when the steam boiler unit is completely inserted in the tank. For maintenance purposes, for example, a rapid assembly and disassembly of the steam boiler unit is thereby possible simply by insertion or withdrawal. In this case, there is provision for the device connector to be in the form of a reinforced device connector so that it has sufficient durability for such use.

There is also provision for constructing the applicator as a steam plate and for arranging the applicator in an upper region of the receiving space between the storage container and the cover. The applicator is also thereby completely received in the housing so that both transport and storage of the steam generator are facilitated because only one object has to be handled or packed away.

There is further provision for constructing the applicator as a steam plate, wherein the steam plate comprises a handle which is constructed thereon opposite a steam discharge face, and wherein the storage container has a recess, in which the handle is received when the steam plate is inserted in the housing. The applicator which is in the form of a steam plate with a handle can consequently be stored in the housing.

There is also provision for providing the steam boiler unit with a pressure vessel having a connection flange and having a closure unit, wherein the connection flange is closed by the closure unit and wherein the closure unit comprises a sensor unit, an excess pressure valve, a reduced pressure valve, a water supply line and a steam outlet. All the supply lines and discharge lines can thereby be coupled and uncoupled with respect to the pressure vessel with one hand action. Maintenance is thereby simplified.

There is further provision for the steam boiler unit to be provided with a pressure vessel having a receiving flange and having a heating rod unit, wherein an electrical component, the heating rod unit, is received in the receiving flange in such a manner that the at least one heating rod of the heating rod unit projects into the pressure vessel and wherein the electrical component is locked to the pressure vessel by a closure component of the heating rod unit. The maintenance is also simplified by such a construction.

There is also provision for the device connector which is a component of the heating rod unit to be connected to the closure component in a positive-locking manner. It is thereby possible to handle the device connector by means of the closure component and consequently the handling thereof is simplified.

There is further provision for the sensor unit to be provided with a filling level sensor and/or a temperature sensor, wherein there is particularly provision for the sensor unit to abut an inner wall of the pressure vessel and thereby to be supported. It is simply possible by measuring the pressure and/or temperature to reliably control the operation of the steam generator.

There is also provision for the housing to be provided with a double hinge which has a first hinge axle and a second hinge axle which is parallel therewith and spaced apart therefrom and by which the tank and the cover are connected. It is thereby possible to construct the tank in an upper region with a massive edge and nevertheless to pivot the cover through more than 180° so that it is parallel with a side wall of the tank in the open state.

There is further provision for providing the storage container with a viewing aperture and for providing the tank with a recess, through which the viewing aperture of the storage container which is received in the tank can be viewed. It is thereby possible, in spite of the storage container being fitted in the housing, to readily control a filling level of the storage container.

There is further provision for a throughflow valve to be constructed in the tank of the housing, wherein an outlet valve of the storage container is coupled to the throughflow valve when the storage container is inserted and wherein the filling pump is connected to the throughflow valve with a suction hose and wherein the filling pump is connected to the steam boiler unit with a pressure hose. It is thereby easier to couple and uncouple the storage container so that it can also be removed from the housing without substantial complexity.

There is also provision for the steam boiler unit to be connected to the applicator via a steam guiding hose and a first storage region to be constructed in the receiving space of the tank between an outer wall of the tank and a central unit which comprises the steam boiler unit and the storage container, wherein the uncoupled steam guiding hose is received in the first storage region and the first applicator is received in a second storage region. The pressure hose can also thereby be stored in the housing and the transport and storage are simplified. There is further provision for a second applicator to be received in a third storage region.

There is further provision for a base to be constructed in the region of the tank base of the tank, wherein a recess is formed in the base, wherein the steam boiler unit is received in the recess, wherein the storage container is positioned on the base and wherein the filling pump is received in a hollow space of the base. A compact and stable construction is thereby ensured.

There is also provision for the tank to be formed in two pieces by a tank base member and a cup-like base closure member, wherein the steam boiler unit and the filling pump are received in the base closure member. As a result of such a construction, complete maintenance of the steam generator is simplified because the tank can be separated into the components tank base member and base closure member for disassembly and pre-assembly, wherein the components are connected by releasable snap-fit connections and/or screw connections.

Finally, there is provision for a separation wall, which extends between the steam boiler unit and the filling pump, to be formed by a wall, which projects from above as far as a base of the base closure member, of the tank base member. A compact and stable construction is thereby ensured and in particular the throughflow valve which is arranged on the tank base member adjacent to the downwardly projecting wall is also reliably supported so that the storage container can be placed with pressure on the throughflow valve with the outlet valve thereof.

There is further provision for the housing of the steam generator to be used as a step. Accordingly, the tank and the cover which form the housing and therefore the step have such dimensions that they readily withstand the loads resulting from an adult who is using this step for work. In this case, the step can be used both for work with an applicator of the steam generator and for other activities, wherein the at least one applicator and a steam guiding hose can then be stored in the housing.

Additional details of the present disclosure will be described in the drawings with reference to schematically illustrated embodiments.

Figure 2:
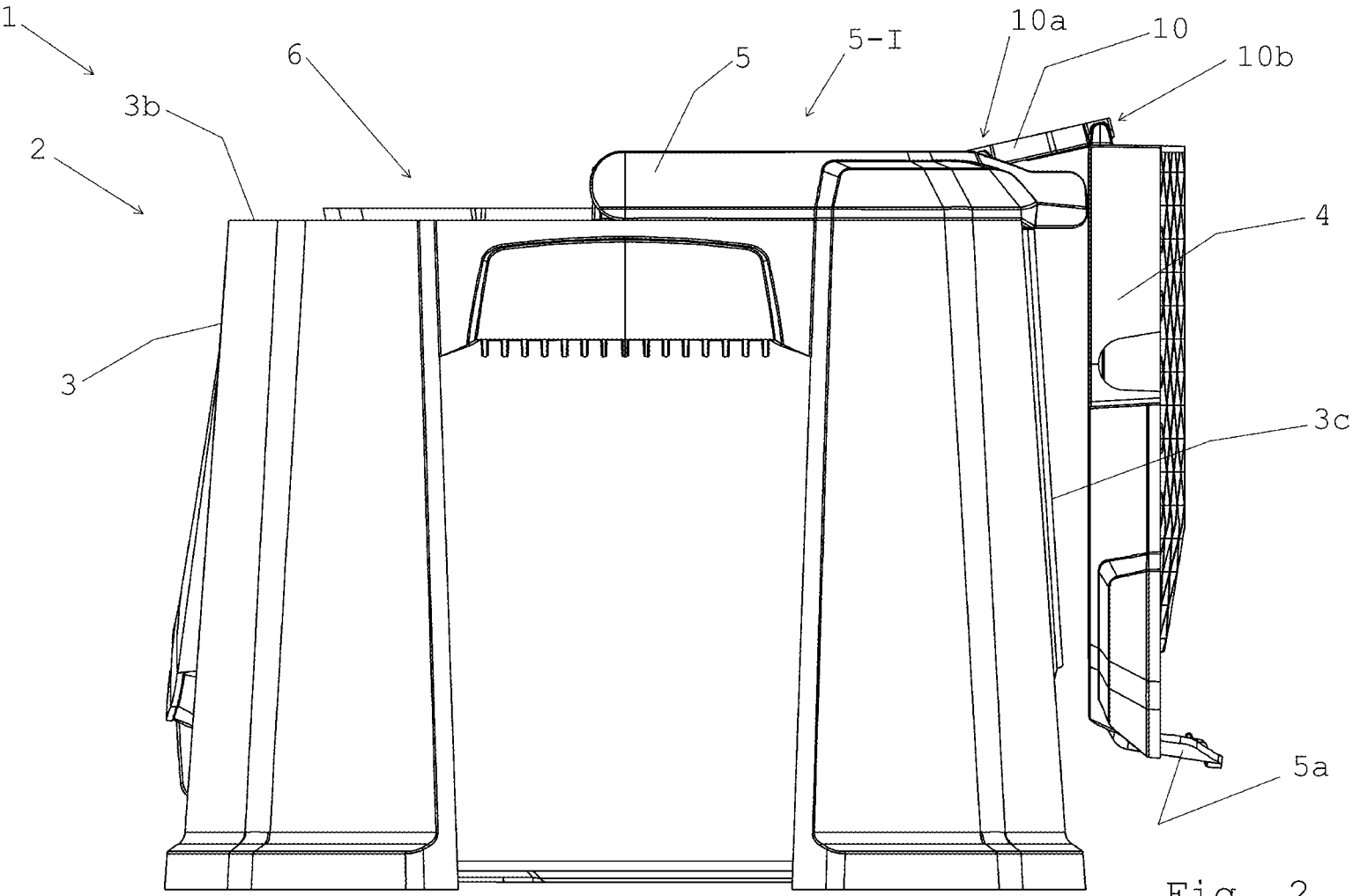
FIG. 2 shows the steam generator shown in FIG. 1 with the cover folded open.

FIG. 1 shows a perspective view of a steam generator 1 according to the present disclosure. The steam generator 1 comprises a housing 2, wherein the housing 2 comprises a tank 3 with a receiving space 6 (see FIG. 2) and a cover 4. The housing further comprises a carrier bracket 5 which can be pivoted out of the position 5-I, which is shown in FIG. 1, into the position 5-II, which is shown in FIG. 2. The cover 4 comprises a resiliently loaded closure flap 5*a* and is locked therewith in the closed position thereof (FIG. 1) on the tank 3. Under the closure flap 5*a* (see FIG. 1), the tank 3 has a recess 3*a*, through which a storage container 12 which is arranged in the receiving space 6 of the tank 3 can be seen. In this instance, a viewing aperture 7 of the storage container 12 can be seen so that a water filling level which the storage container 12 has can be read off. An on/off switch 8 is arranged under the recess 3*a*. A first connection A1-9 for a steam guiding hose 9 is arranged laterally beside the on/off switch 8, wherein it is connected to the first connection A1-9 only during working operation of the steam generator 1. This steam guiding hose 9 leads to a second connection A2-9 which is constructed on the first applicator 13*a* which is shown in FIG. 3, wherein the steam guiding hose 9 is also connected to the applicator 9 only during working operation.

FIG. 2 shows the steam generator 1 as a side view and with the cover 4 folded open. The cover 4 and the tank 3 are connected to a first rotation axle 10*a* and a second rotation axle 10*b* via a double hinge 10 so that the cover 4 can be folded over a massively constructed edge 3*b* of the tank 3 and is suspended parallel with a wall 3*c* of the tank 3.

Figure 3:
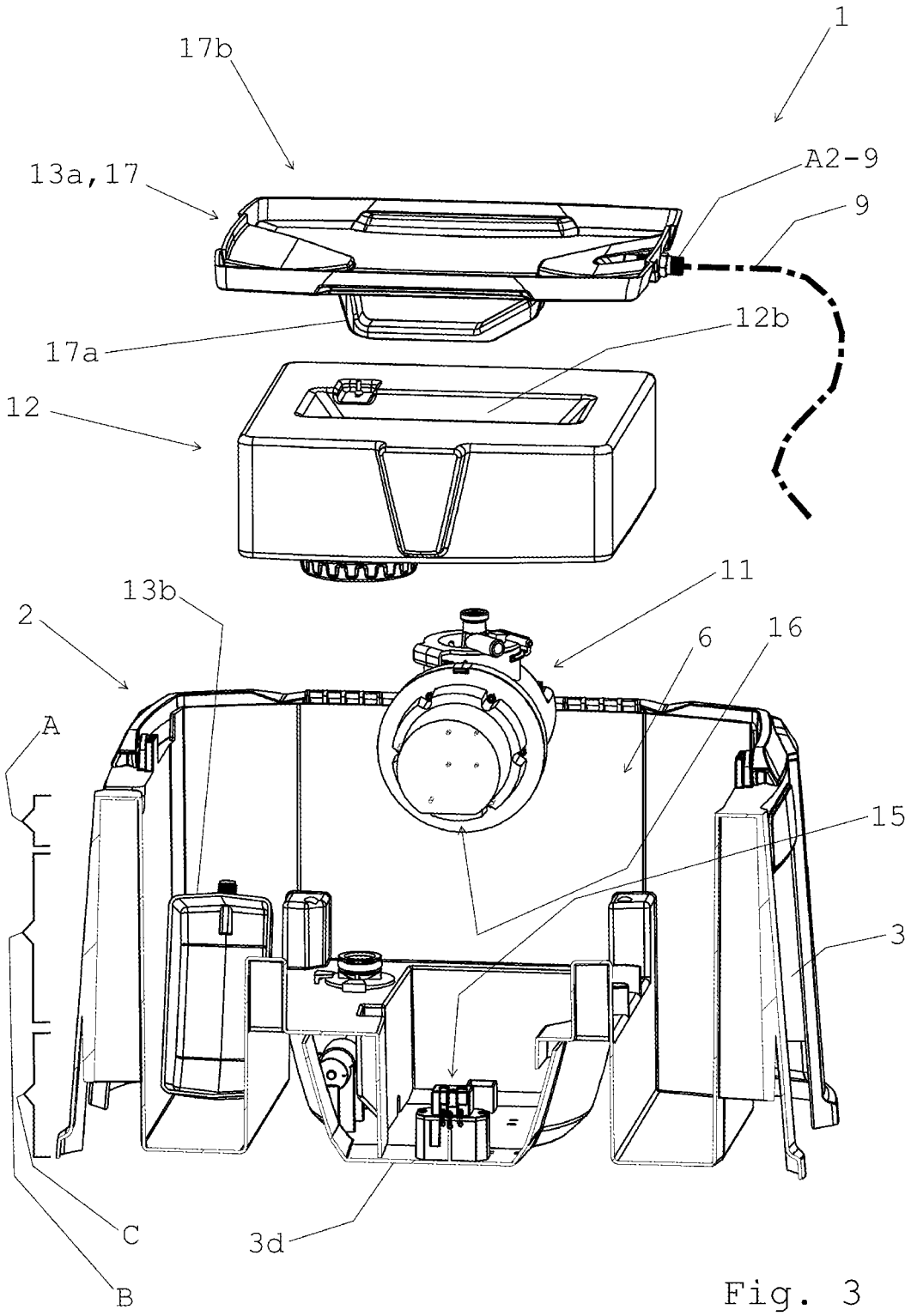
FIG. 3 shows a partially sectioned exploded view of the steam generator shown in FIGS. 1 and 2.

FIG. 3 illustrates a partially sectioned exploded view of the steam generator 1 which is shown in FIGS. 1 and 2, wherein the cover 4 is not shown.

A steam boiler unit 11, a storage container 12 and a first and second applicator 13*a*, 13*b* can be seen in FIG. 3 as additional components of the steam generator 1. In this case, as shown in FIG. 4, the steam boiler unit 11 is inserted into the tank 3 in a lower region C of the receiving space 6 and in this case the storage container 12 is inserted into the tank 3 in a central region B of the receiving space 6 above the steam boiler unit 11 when the steam generator 1 is assembled.

Figure 4:
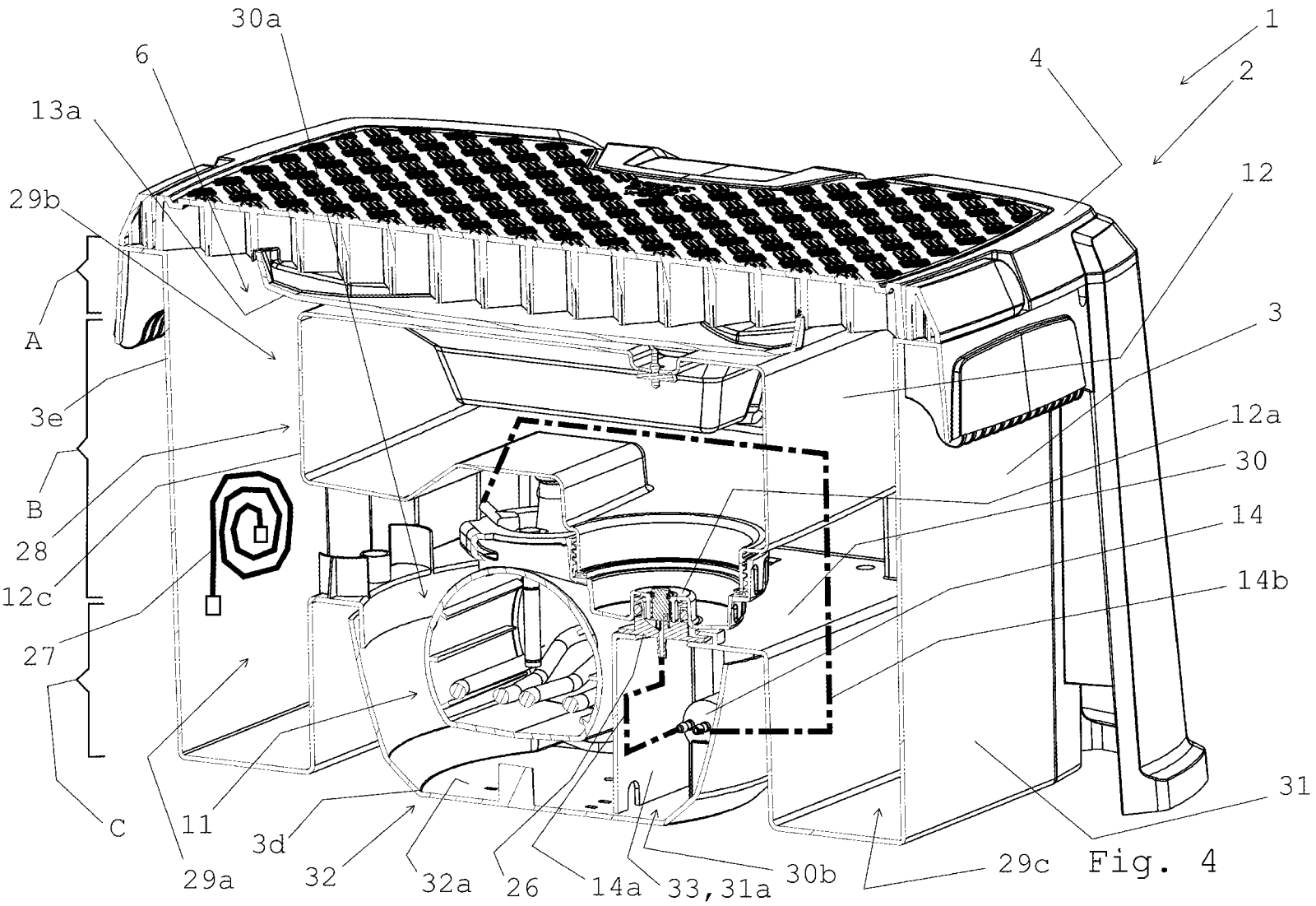
FIG. 4 shows a sectioned view of the steam generator shown in FIG. 1, wherein it is rotated through approximately 180° about the vertical axis.

FIG. 4 shows in the lower region C of the receiving space 6 as an additional component of the steam generator 1 a filling pump 14 which is arranged beside the steam boiler unit 11.

Figure 7:
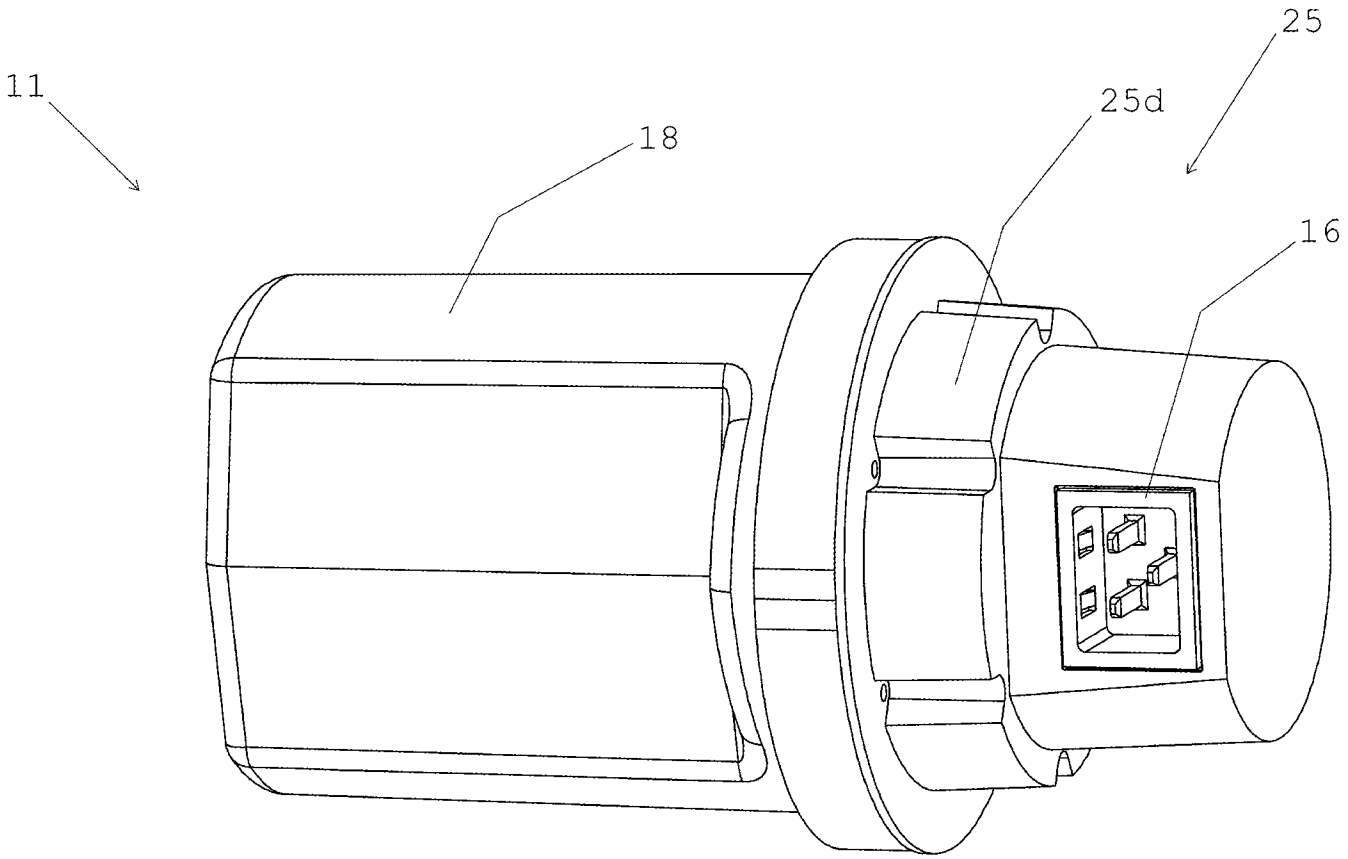
FIG. 7 shows an additional perspective view of the steam boiler unit.

The tank 3 comprises a device coupling 15 (see FIG. 3) which is connected to a tank base 3*d* and the steam boiler unit 11 comprises a device connector 16. The device connector 16 is clearly shown in FIGS. 5 and 7. When the steam boiler unit 11 is completely inserted into the tank 3, the device connector 16 is completely connected to the device coupling 15 (see FIGS. 4 and 8).

The first applicator 13*a* (see, for example, FIG. 3) is in the form of a steam plate 17 and is, as shown in FIG. 4, received in an upper region A of the receiving space 6 between the storage container 12 and the cover 4. The steam plate 17 comprises a handle 17*a* which is constructed thereon opposite a steam discharge face 17*b*. The storage container 12 comprises a recess 12*b*, in which the handle 17*a* is received when the steam plate 17 is inserted in the housing 2 (see FIG. 4).

As can be seen particularly in FIGS. 4, 5, 6 and 7, the steam boiler unit 11 comprises a pressure vessel 18 having a connection flange 18*a* and a closure unit 19. The connection flange 18*a* is closed by the closure unit 19 (only shown in FIG. 6). The closure unit 19 comprises a sensor unit 20, an excess pressure valve 21, a reduced pressure valve 22, a water supply line 23 and a steam outlet 24.

Figure 5:
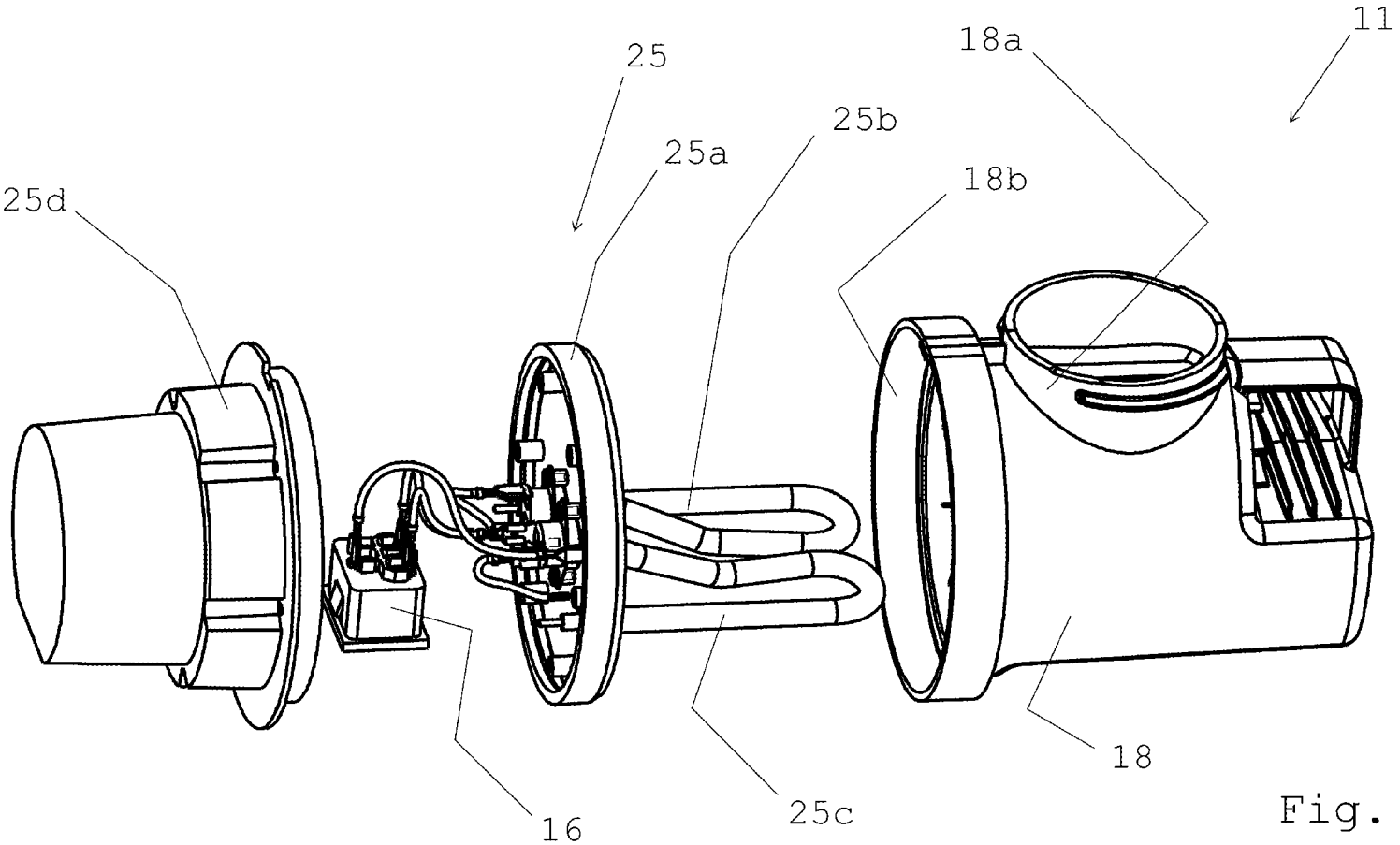
FIG. 5 shows an exploded view of a steam boiler unit without any closure unit.

The steam boiler unit 11 further comprises a heating rod unit 25 and the pressure vessel 18 of the steam boiler unit 11 comprises a receiving flange 18*b* (see particularly FIG. 5). In this case, an electrical component 25*a*, the heating rod unit 25, is received in the receiving flange 18*b* in such a manner that heating rods 25*b*, 25*c* of the heating rod unit 25 project into the pressure vessel 18. In this case, the electrical component 25*a* in the assembled state is locked by a closure component 25*d* of the heating rod unit 25 on the pressure vessel 18. This is carried out, for example, by means of a bayonet-closure-like connection with a seal being interposed.

The device connector 16 (see FIG. 7) which is a component of the heating rod unit 25 is connected to the closure component 25*d* in a positive-locking manner.

The sensor unit 20 (see FIG. 6) comprises a filling level sensor 20*a*. Optionally, it may also comprise a temperature sensor. According to another variant, a temperature sensor is provided on the heating rod unit.

As can be seen particularly in FIG. 4, a throughflow valve 26 is constructed on the tank 3 of the housing 2. With the storage container 12 inserted, a resiliently loaded outlet valve 12*a* of the storage container 12 is coupled to this throughflow valve 26 and thereby opened. The filling pump 14 is connected to the throughflow valve 26 with a suction hose 14*a* which is only schematically illustrated. Furthermore, the filling pump 14 is connected to the closure unit 19 of the steam vessel unit 11 with a pressure hose 14*b* which is only schematically illustrated. Consequently, the steam boiler unit 11 is connected to the storage container 12 via the filling pump 14 so that it can be filled when necessary from the storage container 12.

The outlet valve 12*a* is screwed to a tank member 12*c* of the storage container 12 so that it can be unscrewed for filling the tank member 12*c* with water. With the outlet valve 12*a* unscrewed, it is possible to fill the tank member 12*c* under a water tap or by means of a water hose. After filling, the tank member 12*c* is closed again with the outlet valve 12*a* so that the storage container 12 can be transported without any risk of a loss of water because the outlet valve 12*a* remains closed until it is completely positioned on the throughflow valve 26.

The steam guiding hose 9 which is shown in FIGS. 1 and 3 is shown in FIG. 4 in a state in which it is uncoupled from the first connection and the second connection. In the receiving space 6 of the tank 3, a first storage region 29*a* is constructed between an outer wall 3*e* of the tank 3 and a central unit 28 which comprises the steam boiler unit 11 and the storage container 12, wherein the several-meters-long steam guiding hose 9 is received. Similarly, the first applicator 13*a* can be received in a second storage region 29*b* of the receiving space 6 for transport or storage. The steam guiding hose 9 is suitable both for using the first applicator 13*a* and for using the second applicator 13*b*.

A third storage region 29*c* is constructed opposite the first storage region 29*a*. The second applicator 13*b* shown in FIG. 3 can be received in this third storage region 29*c* during transport or for storage.

A base 30 is formed in the region of the tank base 3*d* of the tank 3, wherein a recess 30*a* is constructed in the base 30, wherein the steam boiler unit 11 is received in the recess 30*a*, wherein the storage container 12 is positioned on the base 30, and wherein the filling pump 14 is received in a hollow space 30*b* of the base 30.

Figure 8:
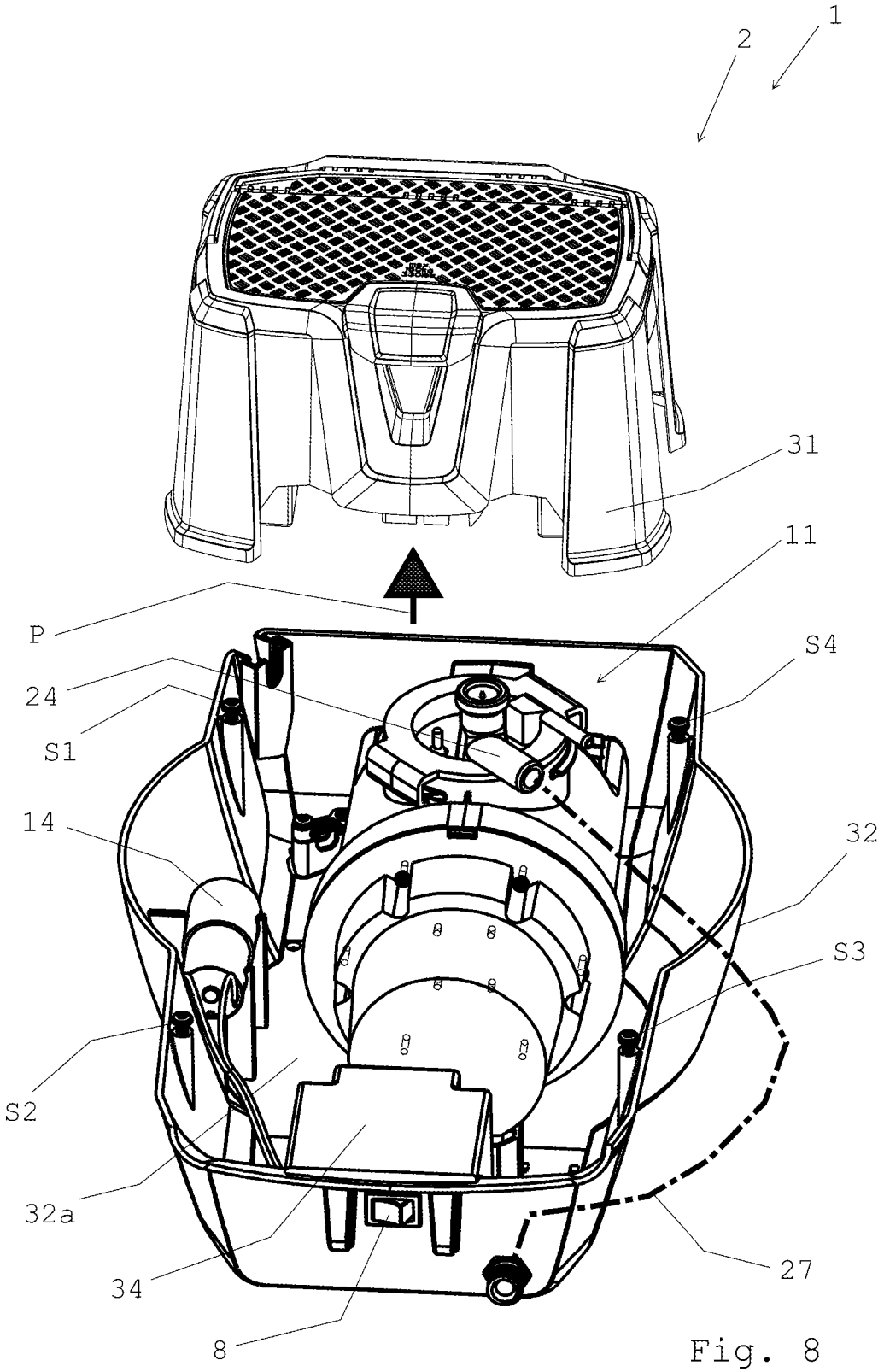
FIG. 8 shows an additional perspective view of a steam generator with a base closure member removed in a downward direction.

In particular by viewing FIGS. 4 and 8 together, it can be seen that the tank 3 is constructed in two pieces and comprises a tank base member 31 and a cup-like base closure member 32. In this case, FIG. 8 shows the tank base member 31 and the base closure member 32 which is separate therefrom to different scales in order to be able to denote details of the base closure member 32 more clearly with reference numerals. The steam boiler unit 11 and the filling pump 14 are received in the base closure member 32. The already mentioned on/off switch 8 is fixed to the base closure member 31. An electronic unit 34 of the steam generator 1, from which the steam generation is controlled, is directly associated therewith. The electronic unit 34 is connected to an electric current source (not illustrated) via a cable (not illustrated).

A separation wall 33 which extends between the steam boiler unit 11 and the filling pump 14 is formed by a wall 31*a*, which projects from above as far as a base 32*a* of the base closure member 32, of the tank base member 31.

FIG. 8 schematically shows a steam supply hose 27, by which the steam outlet 24 is connected to the first connection A1-9. A directional arrow P indicates that the base closure member 32 is inserted from below into the tank base member 31 for assembly. A connection of the two members is then carried out by means of screws S1 to S4, wherein the screws S1 to S4 are separated from the base closure member 32 before assembling the two members and then, after the two members have been assembled, are screwed through the tank base member 31 into the screw bosses of the base closure member 32.

Although the present invention has been described with reference to preferred embodiments, workers skilled in the art will recognize that changes may be made in form and detail without departing from the spirit and scope of the invention.

LIST OF REFERENCE NUMERALS

Figure 6:
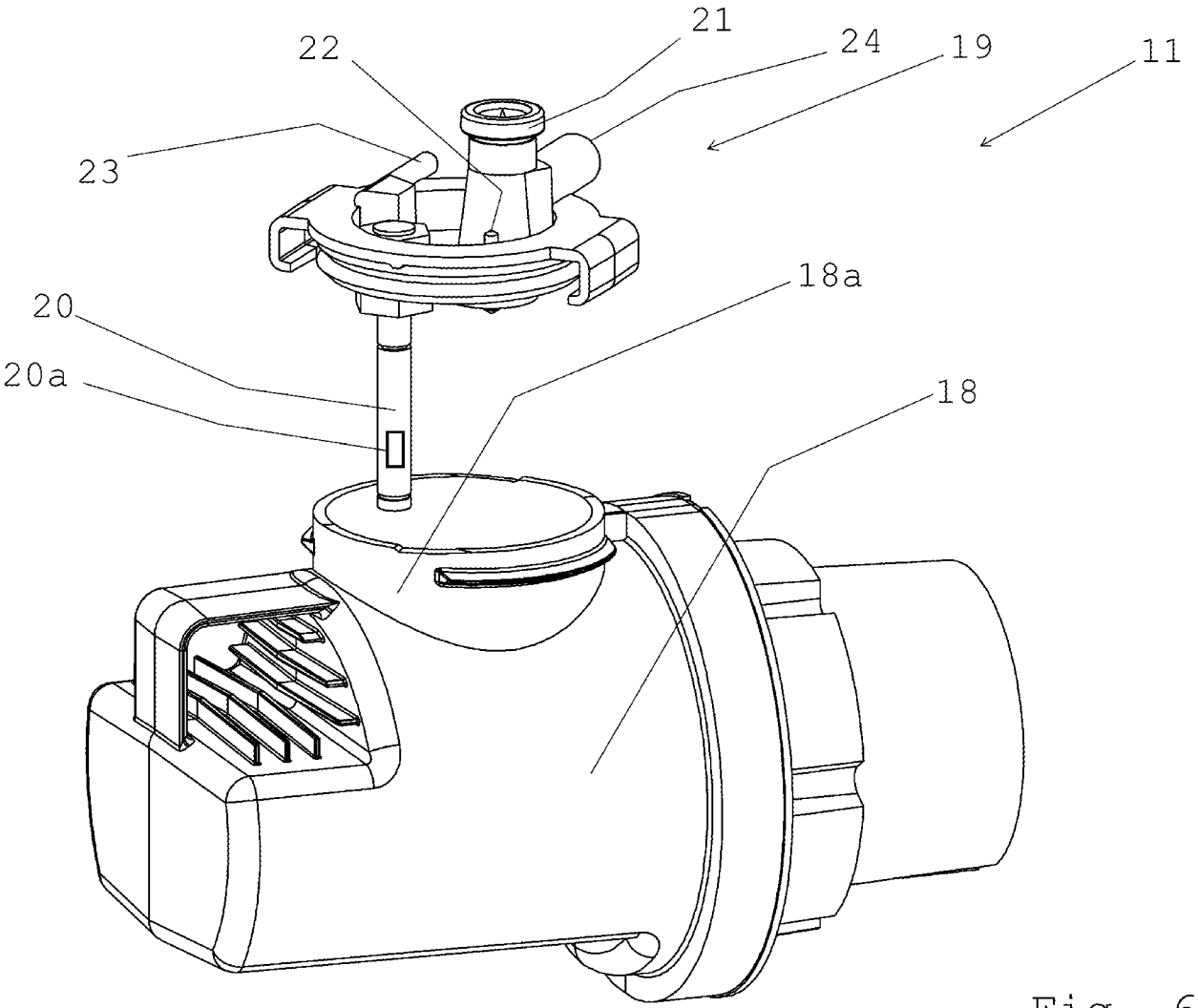
FIG. 6 shows a perspective view of a steam boiler unit with a closure unit removed.

1 Steam generator
2 Housing
3 Tank of 2
3*a* Recess
3*b* Massive edge
3*c* Wall
3*d* Tank base
3*e* Outer wall
4 Cover of 2
5 Carrier bracket of 2
5*a* Closure flap
5-I Position of 5 in FIG. 1
5-II Position of 5 in FIG. 2
6 Receiving space
7 Viewing aperture
8 On/off switch
9 Steam guiding hose
10 Double hinge
10*a/b* First/second rotation axle of 10
11 Steam vessel unit
12 Storage container
12*a* Outlet valve of 12
12*b* Recess
12*c* Tank member
13*a/b* First, second applicator
14 Filling pump
14*a* Suction hose
14*b* Pressure hose
15 Device coupling to 3*d* of 3
16 Device connector to 11
17 Steam plate
17*a* Handle of 17
17*b* Steam discharge face of 17
18 Pressure container of 11
18*a* Connection flange of 18
18*b* Receiving flange
19 Closure unit of 11
20 Sensor unit of 19
20*a* Filling level sensor
21 Excess pressure valve of 19
22 Reduced pressure valve of 19

23 Water supply line of 19
24 Steam outlet of 19
25 Heating rod unit
25*a* Electrical component of 25
25*b*, 25*c* Heating rods of 25
25*d* Closure component of 25
26 Throughflow valve
27 Steam supply hose between 24 and A1-9
28 Central unit formed from 11 and 12
29*a* First storage region of 6 for 9
29*b* Second storage region of 6 for 13*a*
29*c* Third storage region of 6 for 13*b*
30 Base
30*a* Recess in 30
30*b* Hollow space of 30
31 Tank base member of 3
31*a* Wall of 31
32 Base closure member of 3
32*a* Base of 32
33 Separation wall formed by 31*a*
34 Electronic unit
A1-9 First connection for 9
A2-9 Second connection for 9
A Upper region of 6
B Central region of 6
C Lower region of 61
P Directional arrow
S1-S4 Screw

The invention claimed is:

1. A steam generator comprising a storage container, a filling pump, a steam boiler unit, an applicator and a housing, wherein the housing comprises a tank with a receiving space and a cover, wherein the steam boiler unit is inserted into the tank in a lower region of the receiving space and wherein the storage container is inserted into the tank in a central region of the receiving space above the steam boiler unit, wherein the applicator is in the form of a steam plate and the applicator is received in an upper region of the receiving space between the storage container and the cover.

2. The steam generator according to claim 1, wherein the tank comprises a device coupling which is connected to a tank base and the steam boiler unit comprises a device connector, wherein the device connector of the steam boiler unit is connected to the device coupling completely when the steam boiler unit is completely inserted into the tank.

3. The steam generator according to claim 2, wherein the steam plate comprises a handle which is constructed thereon opposite a steam discharge face, and wherein the storage container has a recess, in which the handle is received when the steam plate is inserted in the housing.

4. The steam generator according to claim 2, wherein a base is constructed in a region of the tank base of the tank, wherein a recess is formed in the base, wherein the steam boiler unit is received in the recess, wherein the storage container is positioned on the base and wherein the filling pump is received in a hollow space of the base.

5. The steam generator according to claim 2, wherein the steam boiler unit comprises a pressure vessel having a connection flange and a closure unit, wherein the connection flange is closed by the closure unit and wherein the closure unit comprises a sensor unit, an excess pressure valve, a reduced pressure valve, a water supply line and a steam outlet.

6. The steam generator according to claim 5, wherein the pressure vessel comprises a receiving flange and a heating rod unit, wherein an electrical component, the heating rod unit, is received in the receiving flange in such a manner that at least one heating rod of the heating rod unit projects into the pressure vessel and wherein the electrical component is locked to the pressure vessel by a closure component of the heating rod unit.

7. The steam generator according to claim 6, wherein the device connector which is a component of the heating rod unit is connected to the closure component in a positive-locking manner.

8. The steam generator according to claim 6, wherein the sensor unit comprises a filling level sensor and/or a temperature sensor, wherein there is particularly provision for the sensor unit to abut an inner wall of the pressure vessel and thereby to be supported.

9. The steam generator according to claim 1, wherein the housing comprises a double hinge which has a first hinge axle and a second hinge axle which is parallel therewith and spaced apart therefrom and by which the tank and the cover are connected.

10. The steam generator according to claim 1, wherein the steam boiler unit is connected to the applicator via a steam guiding hose and a first storage region is constructed in the receiving space of the tank between an outer wall of the tank and a central unit which comprises the steam boiler unit and the storage container, wherein the uncoupled steam guiding hose is received in the first storage region and wherein the applicator is received in a second storage region.

11. The steam generator according to claim 1, wherein the tank is formed in two pieces and comprises a tank base member and a cup-like base closure member, wherein the steam boiler unit and the filling pump are received in the cup-like base closure member.

12. The steam generator according to claim 11, wherein a separation wall, which extends between the steam boiler unit and the filling pump, is formed by a wall, which projects from above as far as a base of the cup-like base closure member, of the tank base member.

13. A steam generator comprising a storage container, a filling pump, a steam boiler unit, an applicator and a housing, wherein the housing comprises a tank with a receiving space and a cover, wherein the steam boiler unit is inserted into the tank in a lower region of the receiving space and wherein the storage container is inserted into the tank in a central region of the receiving space above the steam boiler unit, wherein the storage container comprises a viewing aperture, and the tank comprises a recess, through which the viewing aperture of the storage container which is received in the tank can be viewed.

14. A steam generator comprising a storage container, a filling pump, a steam boiler unit, an applicator and a housing, wherein the housing comprises a tank with a receiving space and a cover, wherein the steam boiler unit is inserted into the tank in a lower region of the receiving space and wherein the storage container is inserted into the tank in a central region of the receiving space above the steam boiler unit, wherein a throughflow valve is constructed in the tank of the housing, wherein an outlet valve of the storage container is coupled to the throughflow valve when the storage container is inserted and wherein the filling pump is connected to the throughflow valve with a suction hose and wherein the filling pump is connected to the steam boiler unit with a pressure hose.

* * * * *